US008749599B2

(12) United States Patent
Byun et al.

(10) Patent No.: US 8,749,599 B2
(45) Date of Patent: Jun. 10, 2014

(54) 4-PRIMARY COLOR DISPLAY AND PIXEL DATA RENDERING METHOD THEREOF

(71) Applicant: LG Display Co., Ltd., Seoul (KR)

(72) Inventors: Minchul Byun, Goyang-si (KR); Heumeil Baek, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 103 days.

(21) Appl. No.: 13/649,922

(22) Filed: Oct. 11, 2012

(65) Prior Publication Data

US 2013/0120472 A1 May 16, 2013

(30) Foreign Application Priority Data

Nov. 11, 2011 (KR) ..... 10-2011-0117421

(51) Int. Cl.
*G09G 5/02* (2006.01)

(52) U.S. Cl.
USPC ..... 345/698; 345/690; 345/694; 345/88

(58) Field of Classification Search
USPC ..... 345/87–104, 204–214, 690–699
See application file for complete search history.

(56) References Cited

U.S. PATENT DOCUMENTS

| | | | | |
|---|---|---|---|---|
| 8,248,430 | B2 * | 8/2012 | Hekstra et al. | 345/589 |
| 8,400,480 | B2 * | 3/2013 | Kim et al. | 345/694 |
| 8,502,839 | B2 * | 8/2013 | Tseng et al. | 345/690 |
| 2007/0159492 | A1 * | 7/2007 | Lo et al. | 345/589 |
| 2008/0079755 | A1 * | 4/2008 | Shiomi | 345/690 |
| 2009/0102769 | A1 * | 4/2009 | Kouno et al. | 345/88 |
| 2009/0135207 | A1 * | 5/2009 | Tseng et al. | 345/690 |
| 2010/0013848 | A1 * | 1/2010 | Hekstra et al. | 345/589 |
| 2010/0103187 | A1 * | 4/2010 | Linssen | 345/590 |
| 2010/0265272 | A1 * | 10/2010 | Bae et al. | 345/690 |

* cited by examiner

*Primary Examiner* — Dmitriy Bolotin
(74) *Attorney, Agent, or Firm* — Birch, Stewart, Kolsch & Birch, LLP

(57) ABSTRACT

A 4-primary color display includes a display panel including a plurality of 4-primary color pixels each including red, green, blue, and white liquid crystal cells, and a pixel data rendering circuit for producing 4-primary color pixel data corresponding to a second horizontal resolution, which is equal to a physical horizontal resolution of the display panel, using 3 -primary color pixel data corresponding to a first horizontal resolution, which is two times higher than the physical horizontal resolution of the display panel. The pixel data rendering circuit determines a weighting factor based on a luminance ratio of two 3-primary color pixel data so as to increase a cognitive horizontal resolution of a luminance in the 4-primary color pixel data to the first horizontal resolution, and reflects the weighting factor to the calculation of a gray value of one 4-primary color pixel data.

8 Claims, 8 Drawing Sheets

(REALTED ART)

(A) 3-primary color pixel (B) 4-primary color pixel

(REALTED ART)

FIG. 8

| | Luminance horizontal resolution | | Color horizontal resolution | |
|---|---|---|---|---|
| | Input 3-primary color pixel data | Output 4-primary color pixel data | Input 3-primary color pixel data | Output 4-primary color pixel data |
| FIG. 6 | 2K | 1K | 2K | 1K |
| FIG. 7 | 2K | 2K | 2K | 1K |

K:Physical horizontal resolution of display panel (A)Related art (B)Embodiment of the invention

4-PRIMARY COLOR DISPLAY AND PIXEL DATA RENDERING METHOD THEREOF

This application claims the benefit of Korean Patent Application No. 10-2011-0117421 filed on Nov. 11, 2011 in the Republic of Korea, which is incorporated herein by reference for all purposes as if fully set forth herein.

BACKGROUND OF THE INVENTION

1. Field of the Invention

Embodiments of the invention relate to a multi-primary color.

2. Discussion of the Related Art

As the interest in information displays and a demand for the use of portable information devices increase, a study and the commercialization of flat panel displays having characteristics such as thin profile and lightness in weight have been actively carried out. Examples of the flat panel display include a liquid crystal display (LCD), a field emission displays (FED), a plasma display panels (PDP), and an electroluminescence device.

The flat panel display generally displays various colors through combinations of three primary colors including red (R), green (G), and blue (B). A multi-primary color display using at least four primary colors has been recently introduced to reduce power consumption or to achieve multicolor gamut. In particular, a 4-primary color display for reducing power consumption uses red (R), green (G), blue (B), and white (W). The 4-primary color display receives data RGB of three primary colors and creates data RGBW of four primary colors using the data RGB of the three primary colors.

As shown in FIG. 1, a 4-primary color display further requires a white subpixel for the display of white (W) in each pixel, compared to a 3-primary color display. When a horizontal resolution of a display device is '1920', the 4-primary color display additionally requires 1920 subpixels. However, an increase in the number of subpixels reduces an aperture ratio and increases the number of output channels of a data driver integrated circuit (IC). Hence, the manufacturing cost of the 4-primary color display increases.

An increase in the resolution of the display device has continued so as to display a high definition image. The number of pixels of a horizontal direction has to be doubled, so as to double the horizontal resolution of the display device. As shown in FIG. 2, when pixel informations are doubled and input so as to increase the resolution of the display device, the number of pixels of the 4-primary color display has to be doubled so as to respectively match the pixel informations to the pixels of the 4-primary color display. A first pixel PIX1 of the 4-primary color display corresponds to first pixel data R1G1B1 of three primary colors and thus displays a luminance and colors L1 and C1 of the first pixel data R1G1B1. Further, a second pixel PIX2 of the 4-primary color display corresponds to second pixel data R2G2B2 of three primary colors and thus displays a luminance and colors L2 and C2 of the second pixel data R2G2B2.

In the 4-primary color display, when an effective resolution increases through an increase in a physical resolution, the aperture ratio further decreases and the manufacturing cost further increases.

SUMMARY OF THE INVENTION

Embodiments of the invention provide a 4-primary color display and a pixel data rendering method thereof capable of increasing an effective resolution without an increase in a physical resolution.

In one aspect, there is a 4-primary color display comprising a display panel including a plurality of 4-primary color pixels, each of the plurality of 4-primary color pixels including a red (R) liquid crystal cell for the red display, a green (G) liquid crystal cell for the green display, a blue (B) liquid crystal cell for the blue display, and a white (W) liquid crystal cell for the white display, and a pixel data rendering circuit configured to produce 4-primary color pixel data corresponding to a second horizontal resolution, which is equal to a physical horizontal resolution of the display panel, using 3-primary color pixel data corresponding to a first horizontal resolution, which is two times higher than the physical horizontal resolution of the display panel, determine a weighting factor based on a luminance ratio of two 3-primary color pixel data so as to increase a cognitive horizontal resolution of a luminance with respect to the 4-primary color pixel data to the first horizontal resolution, and reflect the weighting factor to the calculation of a gray value of one 4-primary color pixel data.

In another aspect, there is a pixel data rendering method of a 4-primary color display including a plurality of 4-primary color pixels each including a red (R) liquid crystal cell for the red display, a green (G) liquid crystal cell for the green display, a blue (B) liquid crystal cell for the blue display, and a white (W) liquid crystal cell for the white display, the pixel data rendering method comprising receiving 3-primary color pixel data corresponding to a first horizontal resolution, which is two times higher than a physical horizontal resolution of a display panel, and selecting first 3-primary color pixel data and second 3-primary color pixel data from the 3-primary color pixel data, receiving the selected first and second 3-primary color pixel data to calculate a luminance of the first 3-primary color pixel data and a luminance of the second 3-primary color pixel data, receiving the luminance of the first 3-primary color pixel data and the luminance of the second 3-primary color pixel data to calculate a weighting factor, to which a luminance ratio of the first and second 3-primary color pixel data is reflected, receiving the selected first and second 3-primary color pixel data to calculate average gray values for each of red, green, and blue of the first and second 3-primary color pixel data, and receiving the calculated weighting factor and the average gray values to determine a gray value of one 4-primary color pixel data based on the weighting factor and the average gray values.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 8 illustrates changes in a luminance horizontal resolution and a color horizontal resolution between input 3-primary color pixel data and output 4-primary color pixel data in each of FIG. 6 and FIG. 7;

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Example embodiments of the invention will be described with reference to FIGS. 3 to 10.

Figure 1:
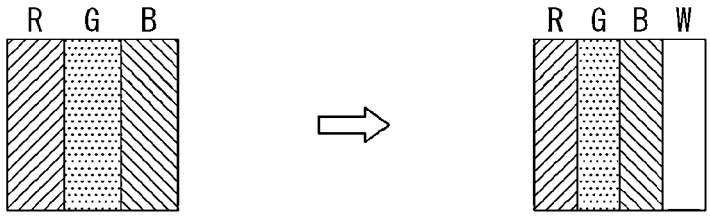
FIG. 1 illustrates a 3-primary color pixel configuration and a 4-primary color pixel configuration.
Figure 2:
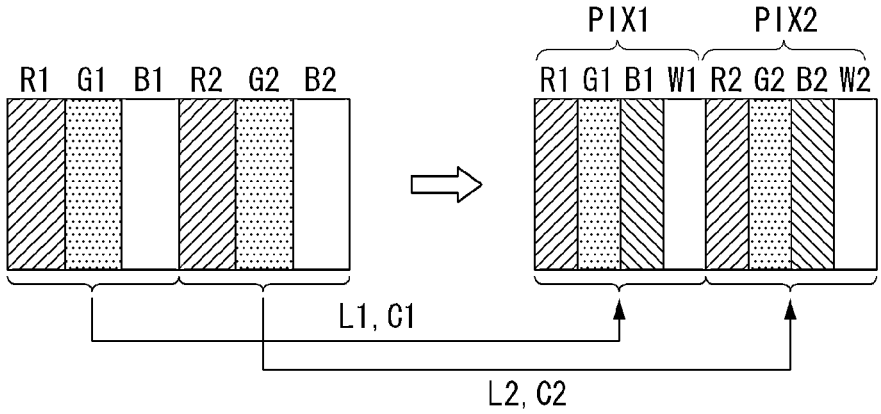
FIG. 2 illustrates that the number of pixels of a 4-primary color display increases so as to increase a resolution.
Figure 3:
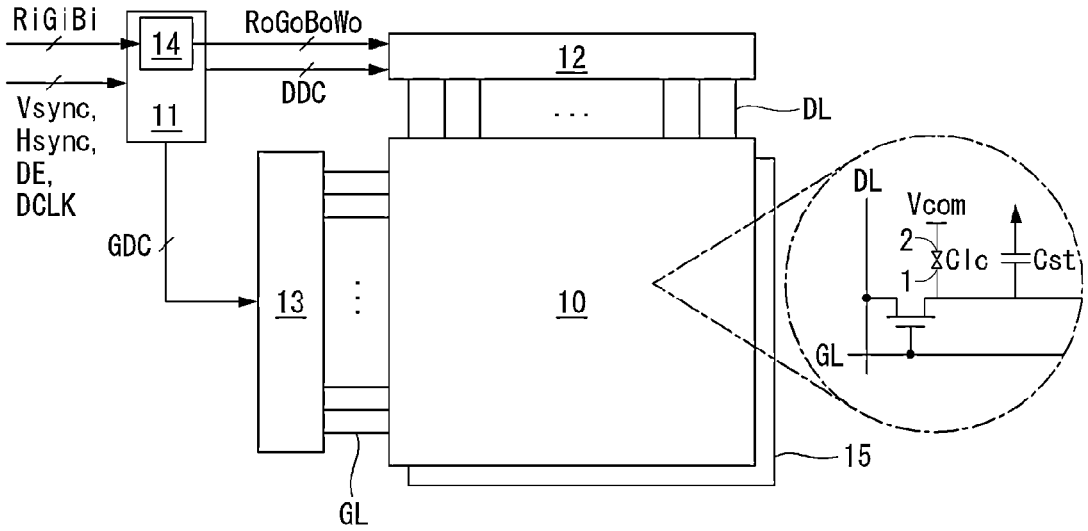
FIG. 3 illustrates a 4-primary color display according to an example embodiment of the invention.
Figure 4:
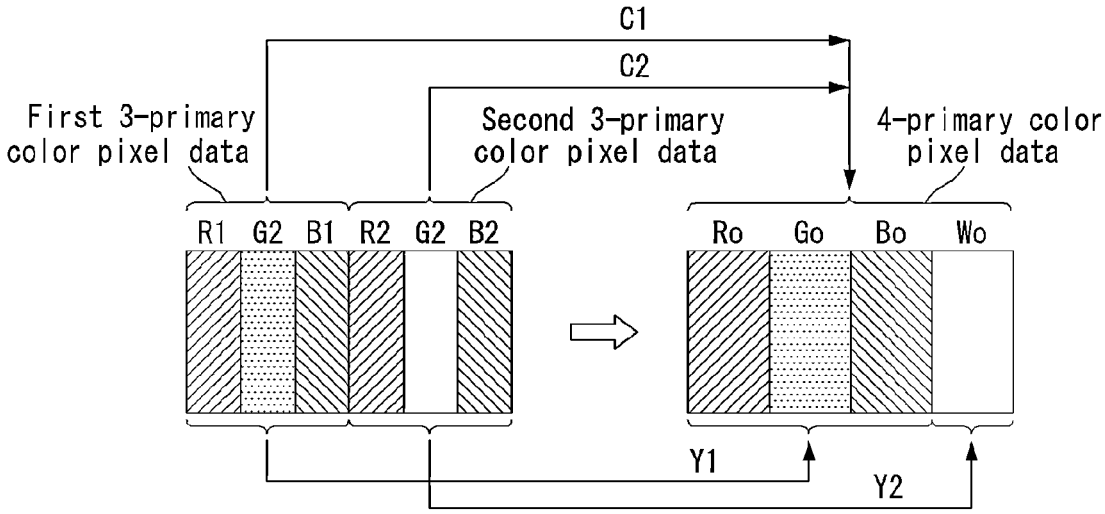
FIG. 4 illustrates a luminance and a color matching between two 3-primary color pixel data and one 4-primary color pixel data.

FIG. 3 illustrates a 4-primary color display according to an example embodiment of the invention. FIG. 4 illustrates a luminance and a color matching between two 3-primary color pixel data and one 4-primary color pixel data.

As shown in FIG. 3, a 4-primary color display according to an example embodiment of the invention includes a display panel 10, a timing controller 11, a data driving circuit 12, a gate driving circuit 13, a pixel data rendering circuit 14, etc.

The 4-primary color display may be implemented as a flat panel display, such as a liquid crystal display (LCD), a field emission display (FED), a plasma display panel (PDP), and an electroluminescence device (EL) including an inorganic electroluminescence element and an organic light emitting diode (OLED). In the following description, the 4-primary color display according to the embodiment of the invention is described using the liquid crystal display. Other flat panel displays may be used.

The display panel 10 includes an upper glass substrate, a lower glass substrate, and a liquid crystal layer between the upper and lower glass substrates. A plurality of data lines DL and a plurality of gate lines GL cross each other on the lower glass substrate of the display panel 10. A plurality of liquid crystal cells C1*c* are arranged on the display panel 10 in a matrix form based on a crossing structure of the data lines DL and the gate lines GL. Each of the plurality of liquid crystal cells C1*c* includes a thin film transistor (TFT), a pixel electrode 1 connected to the TFT, a storage capacitor Cst, and the like.

Black matrixes, color filters, common electrodes 2, etc. are formed on the upper glass substrate of the display panel 10. In a vertical electric field driving manner such as a twisted nematic (TN) mode and a vertical alignment (VA) mode, the common electrodes 2 are formed on the upper glass substrate. In a horizontal electric field driving manner such as an in-plane switching (IPS) mode and a fringe field switching (FFS) mode, the common electrodes 2 are formed on the lower glass substrate along with the pixel electrodes 1.

The liquid crystal cells C1*c* include red (R) liquid crystal cells for displaying a red image, green (G) liquid crystal cells for displaying a green image, blue (B) liquid crystal cells for displaying a blue image, and white (W) liquid crystal cells for displaying a white image. The R, G, B, and W liquid crystal cells constitute a 4-primary color pixel. Polarizing plates are respectively attached to the upper and lower glass substrates of the display panel 10. Alignment layers for setting a pre-tilt angle of liquid crystals on the inner surfaces contacting the liquid crystals are respectively formed on the upper and lower glass substrates of the display panel 10.

The display panel 10 applicable to the embodiment of the invention may be implemented in any liquid crystal mode as well as the TN, VA, IPS, and FFS modes. Moreover, the display device according to the embodiment of the invention may be implemented as any type liquid crystal display including a transmissive liquid crystal display, a transflective liquid crystal display, and a reflective liquid crystal display. The transmissive liquid crystal display and the transflective liquid crystal display each require a backlight unit 15. The backlight unit 15 may be implemented as a direct type backlight unit or an edge type backlight unit.

In the direct type backlight unit 15, a plurality of optical sheets and a diffusion plate are stacked under the display panel 10, and a plurality of light sources are disposed under the diffusion plate. In the edge type backlight unit 15, a plurality of optical sheets and a light guide plate are stacked under the display panel 10, and a plurality of light sources are positioned on the sides of the light guide plate. The plurality of light sources of the backlight unit 15 may be line light sources such as a cold cathode fluorescent lamp (CCFL) and an external electrode fluorescent lamp (EEFL) or point light sources such as a light emitting diode (LED).

The timing controller 11 supplies 3-primary color pixel data RiGiBi received from an external system board to the pixel data rendering circuit 14. The timing controller 11 receives timing signals Vsync, Hsync, DE, and DCLK from the system board. The timing controller 11 generates a data timing control signal DDC and a gate timing control signal GDC for respectively controlling operation timings of the data driving circuit 12 and the gate driving circuit 13 based on the timing signals Vsync, Hsync, DE, and DCLK. The timing controller 11 inserts an interpolation frame between frames of an input image input at a frame frequency of 60 Hz and multiplies the frequency of the data timing control signal DDC by the frequency of the gate timing control signal GDC. Hence, the timing controller 11 can control operations of the data driving unit 12 and the gate driving unit 13 at a frame frequency of (60×N) Hz, where N is a positive integer equal to or greater than 2.

The data driving circuit 12 receives 4-primary color pixel data RoGoBoWo from the pixel data rendering circuit 14. The data driving circuit 12 converts the 4-primary color pixel data RoGoBoWo into positive and negative gamma voltages (i.e., positive and negative data voltages) under the control of the timing controller 11 and supplies the positive and negative data voltages to the data lines DL. For this, the data driving circuit 12 includes a plurality of data driver integrated circuits (ICs). Each of the data driver ICs includes a shift register for sampling a clock, a register for temporarily storing the 4-primary color pixel data RoGoBoWo, a latch that stores data on a per line basis in response to the clock received from the shift register and simultaneously outputs the data each corresponding to one line, a digital-to-analog converter (DAC) for selecting positive and negative gamma voltages corresponding to digital data received from the latch, a multiplexer for selecting the data line DL receiving the positive and negative gamma voltages, an output buffer connected between the multiplexer and the data lines DL, and the like.

The gate driving circuit 13 includes a plurality of gate driver ICs. Each of the gate driver ICs includes a shift register, a level shifter for converting an output signal of the shift register into a signal having a swing width suitable for a TFT drive of the liquid crystal cells, an output buffer, and the like. The gate driving circuit 13 sequentially outputs a scan pulse (or a gate pulse) under the control of the timing controller 11 and supplies the scan pulse to the gate lines GL. Hence, the gate driving circuit 13 selects a horizontal line to receive the data voltage. The shift register of the gate driving circuit 13 may be directly formed on the lower glass substrate based on a GIP (Gate Driver IC In Panel) manner.

The pixel data rendering circuit 14 produces the 4-primary color pixel data RoGoBoWo corresponding to a second horizontal resolution, which is equal to a physical horizontal resolution of the display panel 10, using the 3-primary color pixel data RiGiBi corresponding to a first horizontal resolution, which is two times higher than the physical horizontal resolution of the display panel 10. As shown in FIG. 4, the pixel data rendering circuit 14 produces one 4-primary color pixel data RoGoBoWo using two 3-primary color pixel data R1G1B1 and R2G2B2. Resolution of a spatial frequency in a luminance is higher than that in a color. Thus, when the pixel data rendering circuit 14 produces the 4-primary color pixel data RoGoBoWo, the pixel data rendering circuit 14 determines a weighting factor based on a luminance ratio of the two 3-primary color pixel data R1G1B1 and R2G2B2, so as to increase a cognitive horizontal resolution of the luminance to the first horizontal resolution. The pixel data rendering circuit 14 then reflects the weighting factor to the calculation of a gray value of one 4-primary color pixel data RoGoBoWo.

In the 4-primary color pixel data RoGoBoWo, 'RoGoBo' is data to which a luminance Y1 of the first 3-primary color pixel data R1G1B1 is reflected, and 'Wo' is data to which a luminance Y2 of the second 3-primary color pixel data R2G2B2 is reflected. The pixel data rendering circuit 14 increases the cognitive horizontal resolution of the luminance without an increase in the physical resolution of the display panel 10, thereby efficiently increasing a cognitive spatial frequency without a reduction in an aperture ratio and an increase in the manufacturing cost. However, a color horizontal resolution of the 4-primary color pixel data RoGoBoWo is reduced to about one half of a color horizontal resolution of the 3-primary color pixel data R1G1B1 and R2G2B2 because of the data downscaling resulting from the pixel data rendering circuit 14. Two colors C1 and C2 by the 3-primary color pixel data R1G1B1 and R2G2B2 are represented by one color in the 4-primary color pixel data RoGoBoWo. However, because the resolution of the spatial frequency with respect to color is relatively low (i.e., because a reduction in the color resolution is hardly recognized even when the color resolution is reduced to one half), a reduction in the color horizontal resolution of the 4-primary color pixel data RoGoBoWo hardly matters. The pixel data rendering circuit 14 may be embedded in the timing controller 11.

Figure 5:
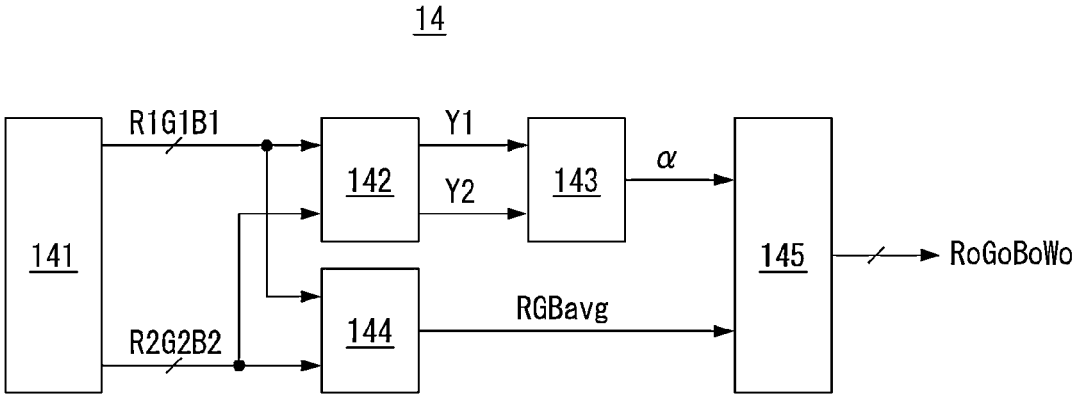
FIG. 5 illustrates in detail a pixel data rendering circuit.

FIG. 5 illustrates in detail the pixel data rendering circuit 14.

As shown in FIG. 5, the pixel data rendering circuit 14 includes a data selection unit 141, a luminance calculation unit 142, a gain calculation unit 143, an average value calculation unit 144, and a data conversion unit 145.

The data selection unit 141 receives the 3-primary color pixel data RiGiBi and selects the first 3-primary color pixel data R1G1B1 and the second 3-primary color pixel data R2G2B2 from the 3-primary color pixel data RiGiBi.

The luminance calculation unit 142 receives the first and second 3-primary color pixel data R1G1B1 and R2G2B2 from the data selection unit 141. The luminance calculation unit 142 then calculates the luminance Y1 of the first 3-primary color pixel data R1G1B1 and the luminance Y2 of the second 3-primary color pixel data R2G2B2 through the following Equation 1.

$$Y1=0.3\times R1+0.6\times G1+0.1\times B1$$

$$Y2=0.3\times R2+0.6\times G2+0.1\times B2 \qquad \text{[Equation 1]}$$

The gain calculation unit 143 receives the luminance Y1 of the first 3-primary color pixel data R1G1B1 and the luminance Y2 of the second 3-primary color pixel data R2G2B2 from the luminance calculation unit 142. The gain calculation unit 143 then calculates a weighting factor α, to which a luminance ratio of the first and second 3-primary color pixel data R1G1B1 and R2G2B2 is reflected, through the following Equation 2.

$$\alpha = 0.5 + 0.5 \times \frac{Y2 - Y1}{Y1 + Y2} \qquad \text{[Equation 2]}$$

The average value calculation unit 144 receives the first and second 3-primary color pixel data R1G1B1 and R2G2B2 from the data selection unit 141. The average value calculation unit 144 then calculates average gray values Ravg, Gavg, and Bavg for each of red, green, and blue of the first and second 3-primary color pixel data R1G1B1 and R2G2B2 through the following Equation 3.

$$Ravg = \frac{(R1 + R2)}{2} \qquad \text{[Equation 3]}$$

$$Gavg = \frac{(G1 + G2)}{2}$$

$$Bavg = \frac{(B1 + B2)}{2}$$

The data conversion unit 145 receives the weighting factor α from the gain calculation unit 143 and receives the RGB average gray values Ravg, Gavg, and Bavg from the average value calculation unit 144. The data conversion unit 145 then applies the weighting factor α and the RGB average gray values Ravg, Gavg, and Bavg to the following Equation 4 to produce the 4-primary color pixel data RoGoBoWo.

$$Ro=Ravg-Wo$$

$$Go=Gavg-Wo$$

$$Bo=Bavg-Wo$$

$$Wo=\alpha\times\min(Ravg\ Gavg,\ Bavg) \qquad \text{[Equation 4]}$$

According to the above Equation 4, a gray value of white data Wo is determined by multiplying a minimum value of the RGB average gray values Ravg, Gavg, and Bavg by the weighting factor α, and a gray value of red data Ro is determined to a value obtained by subtracting the gray value of white data Wo from the R average gray value Ravg. Further, a gray value of green data Go is determined to a value obtained by subtracting the gray value of white data Wo from the G average gray value Gavg, and a gray value of blue data Bo is determined to a value obtained by subtracting the gray value of white data Wo from the B average gray value Bavg.

Figure 6:
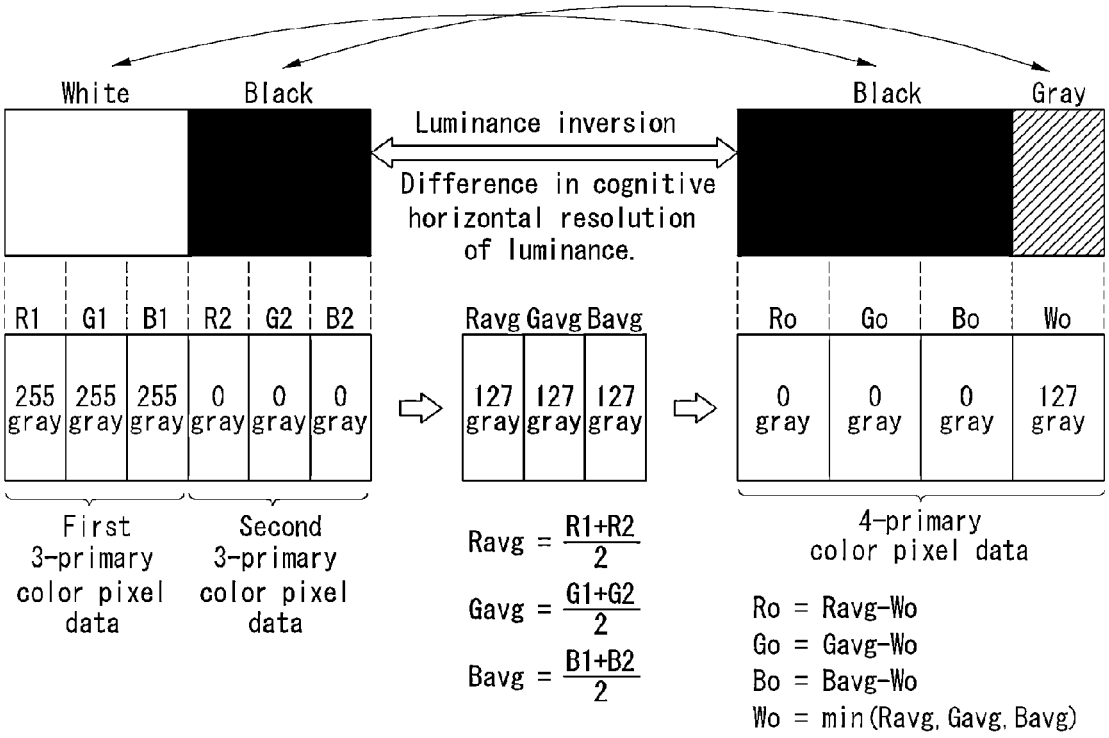
FIG. 6 illustrates an example of producing one 4-primary color pixel data using two 3-primary color pixel data in a related art.
Figure 7:
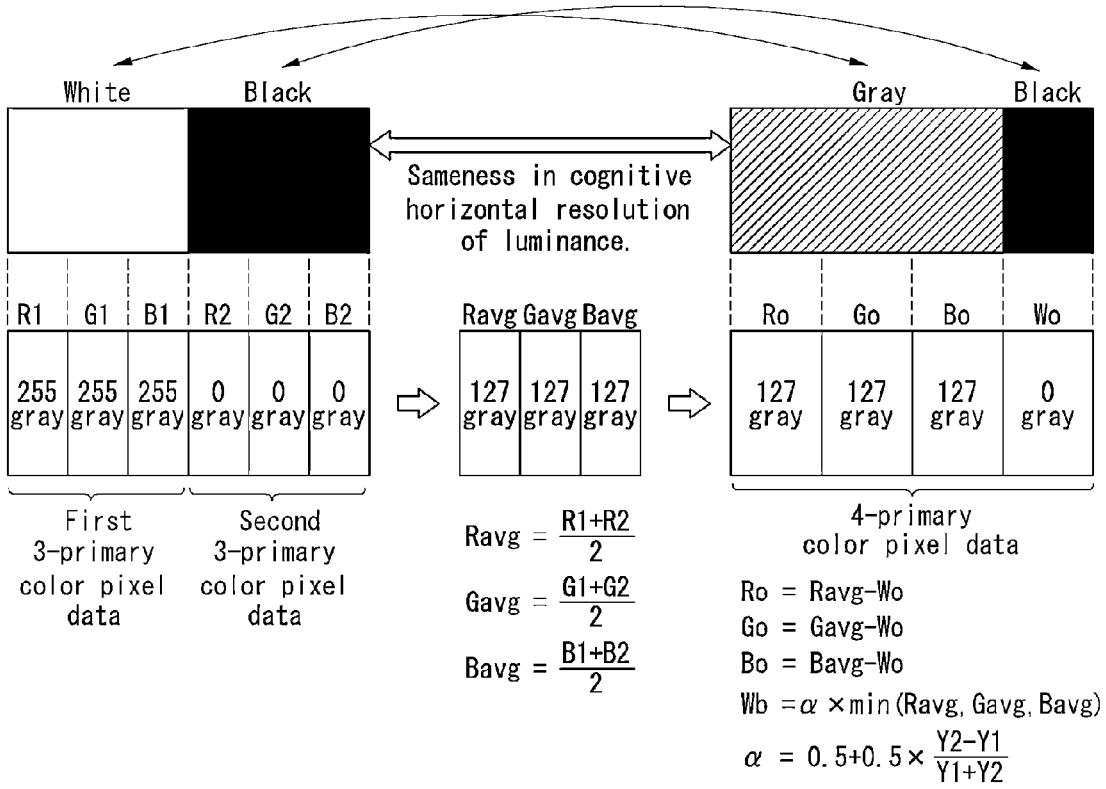
FIG. 7 illustrates an example of producing one 4-primary color pixel data using two 3-primary color pixel data in an example embodiment of the invention.

FIGS. 6 and 7 illustrate examples of producing one 4-primary color pixel data using two 3-primary color pixel data in the related art and the embodiment of the invention. FIG. 8 illustrates changes in a luminance horizontal resolution and a color horizontal resolution between input 3-primary color pixel data and output 4-primary color pixel data in each of FIG. 6 and FIG. 7.

As shown in FIG. 6 illustrating the related art, the weighting factor $\alpha$ is not reflected to the calculation of the gray value of the 4-primary color pixel data RoGoBoWo. For example, when the first 3-primary color pixel data R1G1B1 for the white display is input at 255-gray level and the second 3-primary color pixel data R2G2B2 for the black display is input at 0-gray level, the data RoGoBo of the 4-primary color pixel data RoGoBoWo displays a black of 0-gray level, and the data Wo of the 4-primary color pixel data RoGoBoWo displays a gray of 127-gray level. It can be seen from FIG. 6 that a luminance distribution of the 3-primary color pixel data R1G1B1 and R2G2B2 and a luminance distribution of the 4-primary color pixel data RoGoBoWo are reversed. Namely, there are the bright left side and the dark right side in the luminance distribution of the 3-primary color pixel data R1G1B1 and R2G 2B2. On the other hand, there are the dark left side and the bright right side in the luminance distribution of the 4-primary color pixel data RoGoBoWo. Thus, when the 4-primary color pixel data RoGoBoWo is determined in the related art manner illustrated in FIG. 6, only one luminance may be represented through the 4-primary color pixel data RoGoBoWo. As shown in FIG. 8, a luminance horizontal resolution and a color horizontal resolution of output 4-primary color pixel data RoGoBoWo, which is output in the related art manner illustrated in FIG. 6, are downscaled to one half of those of input 3-primary color pixel data R1G1B1 and R2G2B2. As a result, it is impossible to increase the cognitive horizontal resolution of the luminance.

On the other hand, as shown in FIG. 7 illustrating the embodiment of the invention, the weighting factor is determined based on the luminance ratio of the first and second 3-primary color pixel data R1G1B1 and R2G2B2 and is reflected to the calculation of the gray value of the 4-primary color pixel data RoGoBoWo. For example, when the first 3-primary color pixel data R1G1B1 for the white display is input at 255-gray level and the second 3-primary color pixel data R2G2B2 for the black display is input at 0-gray level, the data RoGoBo of the 4-primary color pixel data RoGoBoWo displays a gray of 127-gray level, and the data Wo of the 4-primary color pixel data RoGoBoWo displays a black of 0-gray level. It can be seen from FIG. 7 that a luminance distribution of the 3-primary color pixel data R1G1B1 and R2G2B2 and a luminance distribution of the 4-primary color pixel data RoGoBoWo are similar to each other. Namely, there are the bright left side and the dark right side in the luminance distribution of the 3-primary color pixel data R1G1B1 and R2G2B2, and there are the bright left side and the dark right side in the luminance distribution of the 4-primary color pixel data RoGoBoWo. Thus, when the 4-primary color pixel data RoGoBoWo is determined in the manner according to the embodiment of the invention illustrated in FIG. 7, two luminances may be represented through the 4-primary color pixel data RoGoBoWo. As shown in FIG. 8, a color horizontal resolution of output 4-primary color pixel data RoGoBoWo, which is output in the manner illustrated in FIG. 7, is downscaled to one half of that of input 3-primary color pixel data R1G1B1 and R2G2B2. However, as shown in FIG. 8, a luminance horizontal resolution of output 4-primary color pixel data RoGoBoWo, which is output in the manner illustrated in FIG. 7, is cognitively held to be equal to that of the input 3-primary color pixel data R1G1B1 and R2G2B2. As a result, it is possible to increase the cognitive horizontal resolution of the luminance without an increase in the physical horizontal resolution.

Figure 9:
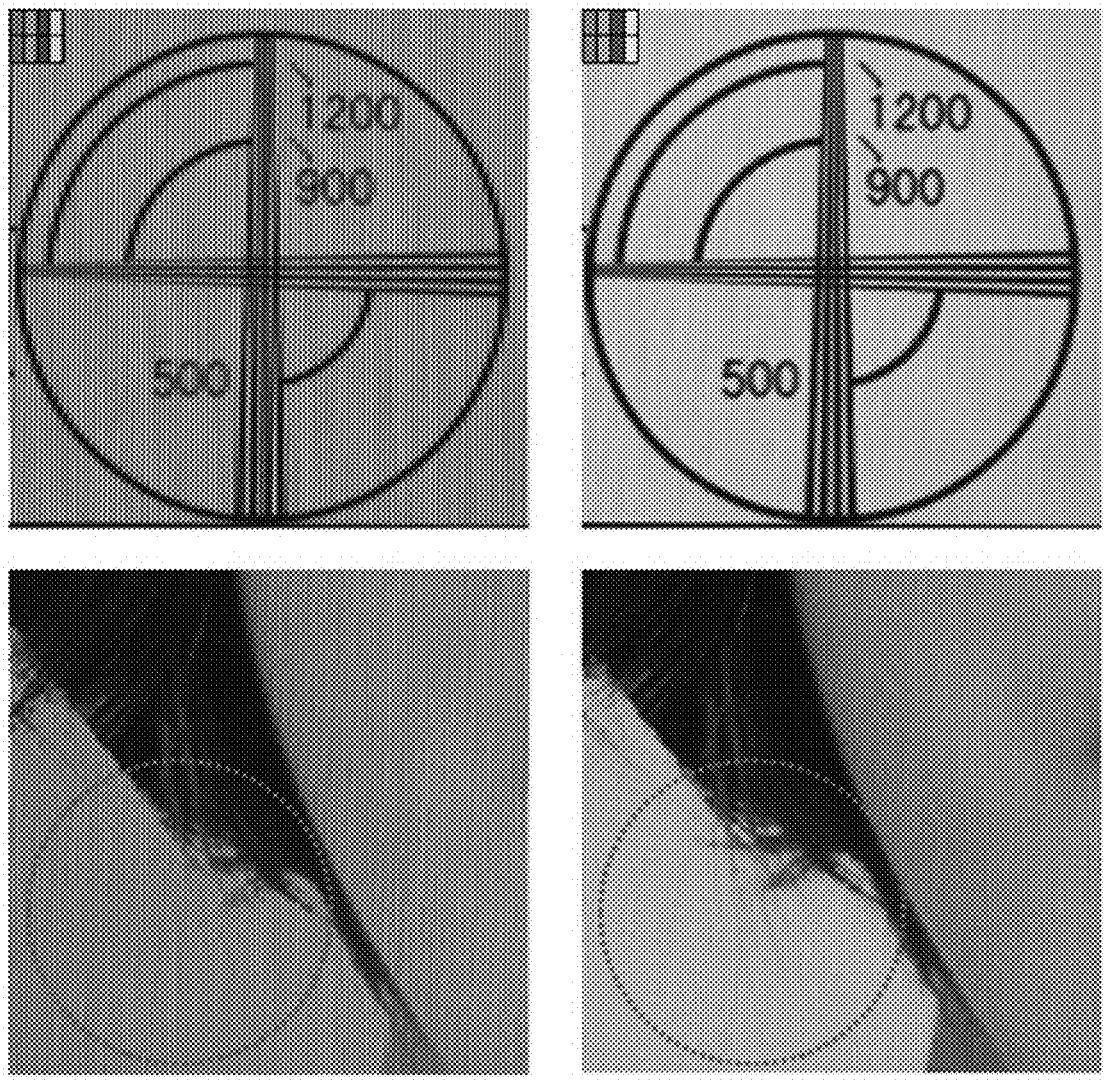
FIG. 9 illustrates an example of images comparing a resolution of a related art with a resolution of an example embodiment of the invention.

FIG. 9 illustrates an example of images comparing a resolution of the related art with a resolution of the embodiment of the invention.

It can be readily seen from FIG. 9 that the definition of the display image in the embodiment of the invention may greatly increase due to an increase in the cognitive horizontal resolution of the luminance, compared to the related art.

Figure 10:
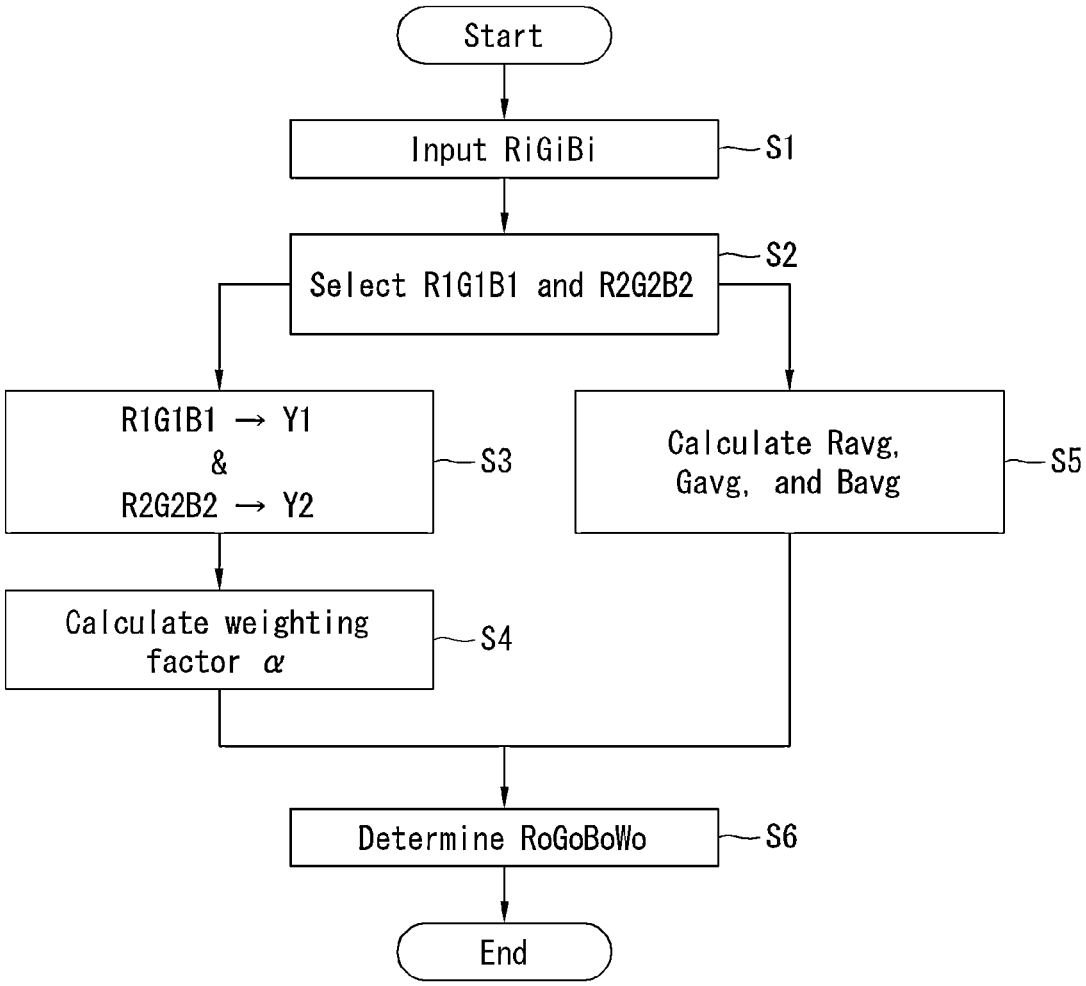
FIG. 10 is a flow chart sequentially illustrating a pixel data rendering method of a 4-primary color display according to an example embodiment of the invention.

FIG. 10 is a flow chart sequentially illustrating a pixel data rendering method of the 4-primary color display according to the embodiment of the invention.

As shown in FIG. 10, the pixel data rendering method according to the embodiment of the invention receives 3-primary color pixel data RiGiBi in step S1 and selects first 3-primary color pixel data R1G1B1 and second 3-primary color pixel data R2G2B2 from the 3-primary color pixel data RiGiBi in step S2.

Next, the pixel data rendering method according to the embodiment of the invention applies the selected first and second 3-primary color pixel data R1G1B1 and R2G2B2 to the above Equation 1 to calculate a luminance Y1 of the first 3-primary color pixel data R1G1B1 and a luminance Y2 of the second 3-primary color pixel data R2G2B2 in step S3.

Next, the pixel data rendering method according to the embodiment of the invention applies the luminance Y1 of the first 3-primary color pixel data R1G1B1 and the luminance Y2 of the second 3-primary color pixel data R2G2B2 to the above Equation 2 to calculate a weighting factor $\alpha$, to which a luminance ratio of the first and second 3-primary color pixel data R1G1B1 and R2G2B2 is reflected, in step S4.

Next, the pixel data rendering method according to the embodiment of the invention applies the selected first and second 3-primary color pixel data R1G1B1 and R2G2B2 to the above Equation 3 to calculate average gray values Ravg, Gavg, and Bavg for red, green, and blue of the first and second 3-primary color pixel data R1G1B1 and R2G2B2 in step S5.

Next, the pixel data rendering method according to the embodiment of the invention applies the calculated weighting factor $\alpha$ and the RGB average gray values Ravg, Gavg, and Bavg to the above Equation 4 to produce 4-primary color pixel data RoGoBoWo in step S6. In the 4-primary color pixel data RoGoBoWo, a gray value of white data Wo is determined by multiplying a minimum value of the RGB average gray values Ravg, Gavg, and Bavg by the weighting factor $\alpha$, and a gray value of red data Ro is determined to a value obtained by subtracting the gray value of white data Wo from the R average gray value Ravg. Further, a gray value of green data Go is determined to a value obtained by subtracting the gray value of white data Wo from the G average gray value Gavg, and a gray value of blue data Bo is determined to a value obtained by subtracting the gray value of white data Wo from the B average gray value Bavg.

As described above, the 4-primary color display and the pixel data rendering method thereof according to the embodiment of the invention produce the 4-primary color pixel data corresponding to the second horizontal resolution, which is equal to the physical horizontal resolution of the display panel, using the 3-primary color pixel data corresponding to the first horizontal resolution, which is two times higher than the physical horizontal resolution of the display panel. In this instance, the weighting factor is determined based on the luminance ratio of the two 3-primary color pixel data and is reflected to the calculation of the gray value of one 4-primary color pixel data, so as to increase the cognitive horizontal resolution of the luminance with respect to the 4-primary color pixel data to the first horizontal resolution. Thus, the embodiment of the invention increases the cognitive horizontal resolution of the luminance without an increase in the physical resolution, thereby efficiently increasing the cognitive spatial frequency without a reduction in the aperture ratio and an increase in the manufacturing cost. As a result, the embodiment of the invention greatly increases the definition of the display image.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A 4-primary color display comprising:

a display panel including a plurality of 4-primary color pixels, each of the plurality of 4-primary color pixels including a red (R) liquid crystal cell for a red display, a green (G) liquid crystal cell for a green display, a blue (B) liquid crystal cell for a blue display, and a white (W) liquid crystal cell for a white display; and a pixel data rendering circuit configured to produce 4-primary color pixel data corresponding to a second horizontal resolution, which is equal to a physical horizontal resolution of the display panel, using 3-primary color pixel data corresponding to a first horizontal resolution, which is two times higher than the physical horizontal resolution of the display panel, determine a weighting factor based on a luminance ratio of two 3-primary color pixel data so as to increase a cognitive horizontal resolution of a luminance with respect to the 4-primary color pixel data to the first horizontal resolution, and reflect the weighting factor to the calculation of a gray value of one 4-primary color pixel data.

2. The 4-primary color display of claim 1, wherein the pixel data rendering circuit includes:

a data selection unit configured to receive the 3-primary color pixel data and select first 3-primary color pixel data and second 3-primary color pixel data from the 3-primary color pixel data;

a luminance calculation unit configured to receive the selected first and second 3-primary color pixel data and calculate a luminance of the first 3-primary color pixel data and a luminance of the second 3-primary color pixel data;

a gain calculation unit configured to receive the luminance of the first 3-primary color pixel data and the luminance of the second 3-primary color pixel data and calculate a weighting factor, to which a luminance ratio of the first and second 3-primary color pixel data is reflected;

an average value calculation unit configured to receive the selected first and second 3-primary color pixel data and calculate average gray values for each of red, green, and blue of the first and second 3-primary color pixel data; and a data conversion unit configured to receive the calculated weighting factor and the average gray values and determine the gray value of the one 4-primary color pixel data based on the weighting factor and the average gray values.

3. The 4-primary color display of claim 2, wherein the gain calculation unit applies the luminance of the first 3-primary color pixel data and the luminance of the second 3-primary color pixel data to the following Equation to calculate the weighting factor:

$$\alpha = 0.5 + 0.5 \times \frac{Y2 - Y1}{Y1 + Y2}$$

where 'α' is the weighting factor, 'Y1' is the luminance of the first 3-primary color pixel data, and 'Y2' is the luminance of the second 3-primary color pixel data.

4. The 4-primary color display of claim 2, wherein the data conversion unit determines a gray value of white data constituting the 4-primary color pixel data by the multiplication between a minimum value of the average gray values and the weighting factor, wherein the data conversion unit determines a gray value of red data constituting the 4-primary color pixel data to a value obtained by subtracting the gray value of white data from a R average gray value among the average gray values, wherein the data conversion unit determines a gray value of green data constituting the 4-primary color pixel data to a value obtained by subtracting the gray value of white data from a G average gray value among the average gray values, wherein the data conversion unit determines a gray value of blue data constituting the 4-primary color pixel data to a value obtained by subtracting the gray value of white data from a B average gray value among the average gray values.

5. A pixel data rendering method of a 4-primary color display including a plurality of 4-primary color pixels each including a red (R) liquid crystal cell for a red display, a green (G) liquid crystal cell for a green display, a blue (B) liquid crystal cell for a blue display, and a white (W) liquid crystal cell for a white display, the pixel data rendering method comprising:

receiving 3-primary color pixel data corresponding to a first horizontal resolution, which is two times higher than a physical horizontal resolution of a display panel, and selecting first 3-primary color pixel data and second 3-primary color pixel data from the 3-primary color pixel data;

receiving the selected first and second 3-primary color pixel data to calculate a luminance of the first 3-primary color pixel data and a luminance of the second 3-primary color pixel data;

receiving the luminance of the first 3-primary color pixel data and the luminance of the second 3-primary color pixel data to calculate a weighting factor, to which a luminance ratio of the first and second 3-primary color pixel data is reflected;

receiving the selected first and second 3-primary color pixel data to calculate average gray values for each of red, green, and blue of the first and second 3-primary color pixel data; and receiving the calculated weighting factor and the average gray values to determine a gray value of one 4-primary color pixel data based on the weighting factor and the average gray values.

6. The pixel data rendering method of claim 5, wherein the 4-primary color pixel data is produced to correspond to a second horizontal resolution, which is equal to the physical horizontal resolution of the display panel, wherein a cognitive horizontal resolution of a luminance with respect to the 4-primary color pixel data increases to the first horizontal resolution.

7. The pixel data rendering method of claim 5, wherein the calculating of the weighting factor includes applying the luminance of the first 3-primary color pixel data and the luminance of the second 3-primary color pixel data to the following Equation to calculate the weighting factor:

$$\alpha = 0.5 + 0.5 \times \frac{Y2 - Y1}{Y1 + Y2}$$

where 'α' is the weighting factor, 'Y1' is the luminance of the first 3-primary color pixel data, and 'Y2' is the luminance of the second 3-primary color pixel data.

8. The pixel data rendering method of claim 5, wherein the determining of the gray value of the one 4-primary color pixel data includes: determining a gray value of white data constituting the 4-primary color pixel data by the multiplication between a minimum value of the average gray values and the weighting factor; determining a gray value of red data constituting the 4-primary color pixel data to a value obtained by subtracting the gray value of white data from a R average gray value among the average gray values; determining a gray value of green data constituting the 4-primary color pixel data to a value obtained by subtracting the gray value of white data from a G average gray value among the average gray values; and determining a gray value of blue data constituting the 4-primary color pixel data to a value obtained by subtracting the gray value of white data from a B average gray value among the average gray values.

* * * * *